United States Patent [19]

Kulprathipanja et al.

[11] Patent Number: 4,475,954

[45] Date of Patent: Oct. 9, 1984

[54] SEPARATION OF SUCROSE FROM THICK JUICE

[75] Inventors: Santi Kulprathipanja, Hoffman Estates; Richard W. Neuzil, Downers Grove; Arthur M. Landis, Carpentersville, all of Ill.

[73] Assignee: UOP Inc., Des Plaines, Ill.

[21] Appl. No.: 485,350

[22] Filed: Apr. 15, 1983

Related U.S. Application Data

[63] Continuation-in-part of Ser. No. 329,358, Dec. 9, 1981, abandoned.

[51] Int. Cl.[3] ..... C13D 3/14

[52] U.S. Cl. ..... 127/46.3; 127/55

[58] Field of Search ..... 127/46.3, 55, 46.2; 210/691, 673, 674; 502/60

[56] References Cited

U.S. PATENT DOCUMENTS

| | | | |
|---|---|---|---|
| 3,130,007 | 5/1964 | Rabo et al. | 502/60 |
| 3,354,096 | 11/1967 | Young | 502/60 |
| 4,226,639 | 10/1980 | Michalko et al. | 127/46.3 |
| 4,238,243 | 12/1980 | Tu et al. | 127/46.3 |
| 4,248,737 | 2/1981 | Kulprathipanja | 127/46.3 |
| 4,287,001 | 9/1981 | Kulprathipanja et al. | 127/46.3 |
| 4,295,994 | 10/1981 | Kulprathipanja | 127/46.3 |
| 4,298,501 | 11/1981 | Kulprathipanja | 127/46.3 |
| 4,332,623 | 6/1982 | Ando et al. | 127/46.2 |
| 4,333,768 | 6/1982 | Kulprathipanja et al. | 127/46.2 |
| 4,333,769 | 6/1982 | Kulprathipanja et al. | 127/46.2 |
| 4,333,770 | 6/1982 | Neuzil et al. | 127/46.3 |
| 4,337,171 | 6/1982 | Kulprathipanja et al. | 127/46.3 |
| 4,405,455 | 9/1983 | Ando et al. | 210/284 |
| 4,421,567 | 12/1983 | Kulprathipanja et al. | 127/46.3 |
| 4,431,456 | 2/1984 | Kulprathipanja | 127/46.3 |

*Primary Examiner*—Richard V. Fisher
*Assistant Examiner*—Karen L. Hodson
*Attorney, Agent, or Firm*—James R. Hoatson, Jr.; Louis A. Morris; William H. Page, II

[57] ABSTRACT

Sucrose which is found in thick juice such as obtained from sugar beet or sugar cane may be selectively extracted therefrom by passing an aqueous solution of the thick juice over a solid adsorbent comprising a stabilized type Y zeolite such as Union Carbide Corporation LZ-Y20 adsorbent, preferably bound with a water permeable organic polymer. The sucrose will be selectively adsorbed thereon and separated from other thick juice ingredients such as raffinose, KCl and betaine. The sucrose is then removed from the adsorbent by treatment with a desorbent material comprising an alcohol. The desorbent is flushed from the adsorbent with water prior to the subsequent contact of the adsorbent with the feed stream.

18 Claims, 1 Drawing Figure

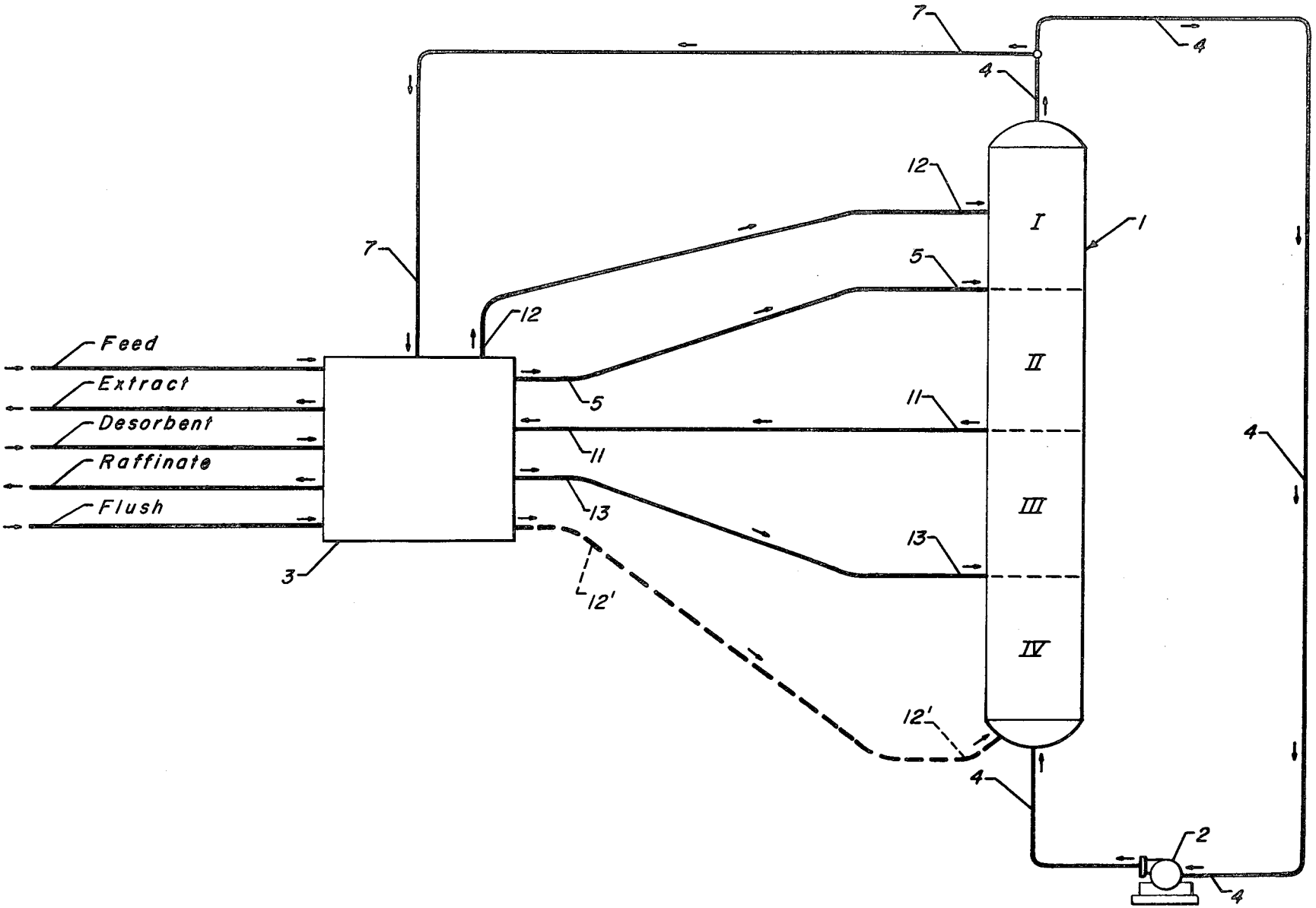
I
II
III
IV
1
2
3
4
5
7
11
12
12'
13
Feed
Extract
Desorbent
Raffinate
Flush

SEPARATION OF SUCROSE FROM THICK JUICE

CROSS REFERENCE TO RELATED APPLICATION

This application is a continuation-in-part of prior copending application Ser. No. 329,358, filed Dec. 9, 1981, incorporated herein by reference, now abandoned.

BACKGROUND OF THE INVENTION

1. Field of the Invention

The field of art to which this invention pertains is solid-bed adsorptive separation. More specifically, the invention relates to an improved process for separating sucrose from thick juice.

2. Prior Art

Sucrose, which is a common form of sugar, is widely used in the food industry. The usual source for this compound is found in the juice of sugar cane, sugar beets and other sucrose-containing materials, known as "thick juice". The usual method of obtaining pure sucrose is to first recover a portion of it by crystallization from the thick juice, and then recover as much as possible of the sucrose remaining in the mother liquors, which are generally termed "molasses," which will still contain a relatively large amount of sucrose along with other sugars such as glucose, fructose, raffinose, etc. The latter compounds along with salts, amino acids, betaine, pyrolidone, carboxylic acid, etc., constitute crystallization inhibitors which make the recovery of the remaining sucrose difficult to accomplish and thus make the recovery of the sucrose no longer economically practical. In addition, the impurities which are present impart a taste to the molasses which renders the same inedible for human consumption.

Sugar beet molasses may contain approximately 50% sucrose and, therefore, it is highly desirable to extract this sucrose from the aforesaid molasses. Inasmuch as hereinbefore set forth, the molasses is bitter in human taste, the residual molasses it used in animal feed or as a fertilizer, and therefore a relatively low sucrose content is an acceptable feature of the molasses. At the present time there are only a few methods for extracting the sucrose present in molasses from the compounds of the type hereinbefore set forth. One such process which is utilized is the Steffan process in which the beet molasses is diluted to about 20% solids, refrigerated, and treated with a calcium compound such as calcium oxide. This results in the reaction of the sucrose present with the calcium oxide to form tricalcium sucrate which is an insoluble granular precipitate. This precipitate can then be removed from the diluted molasses solution by filtration followed by washing, to remove adhering impurities. The tricalcium sucrate is returned to the beet processing operation by adding to the incoming hot beet juice. Under such conditions, the tricalcium sucrate decomposes, releasing the sucrose to solution so that the calcium oxide has acted as a purification agent. However, a disadvantage which is inherent in the process is that certain impurities are recycled, particularly raffinose, which is a trihydrate material. With the continual recycling of the tricalcium sucrate, the amount of raffinose present begins to accumulate and, as hereinbefore discussed, will retard the desired crystallization of the sucrose, thus making it necessary to discard a certain amount of circulating molasses from time to time.

In addition to the Steffan process, it is also possible to separate sucrose from molasses by utilizing non-continuous chromatographic procedures which employ ion exchange resins to isolate sucrose from the molasses. The processes which effect this separation employ a strong acid, polystyrene ion exchange resin in the alkaline or alkaline earth form and typically are as described by H. J. HONGISTO (Technical Department, Finnish Sugar Company Ltd., Kantvik, Finland), *Chromatographic Separation of Sugar Solutions; The Finsugar Molasses Desugarization Process;* paper presented to the 23rd Tech. Conf., British Sugar Comp. Ltd., 1976; and by Dr. MOHAMMAD MUNIR (Central Laboratory, Suddeutsche Zucker AG., 6719 Obrigheim 5, Wormser Str. 1, Germany), "Molasses Sugar Recovery by Liquid Distribution Chromatography;" the *International Sugar Journal,* 1976, 78, 100–106. Other processes for separating components of molasses using ion exchange resins are as described in U.S. Pat. Nos. 4,101,338; 4,046,590; 3,975,205; and 3,884,714. However, none of the above procedures utilizing ion exchange resins achieves efficient separation of the sucrose, even though high purity can be obtained, primarily because the ion exchange resin is inefficient in separating sucrose from betaine. A further disadvantage relating to the use of ion exchange resins is that they require periodic backflushing and regeneration.

Attempts heretofore made to use zeolitic material as an adsorbent selective for sucrose were deemed successful only where it could be tolerated that certain other components of molasses such as raffinose and colored bodies would be adsorbed with the sucrose and be part of the sucrose product extract stream.

It has now been discovered that sucrose may be separated and recovered directly from thick juice by an adsorption-desorption technique utilizing, as the adsorbent therefor, a certain new zeolitic adsorbent.

SUMMARY OF THE INVENTION

In brief summary, the invention is, in a primary embodiment, a process for separating sucrose from a feed mixture comprising thick juice which comprises contacting the mixture at adsorption conditions in an adsorption zone with an adsorbent exhibiting selectivity for the sucrose comprising a stabilized type Y zeolite, thereby selectively adsorbing the sucrose thereon, removing a raffinate stream from the adsorption zone, and thereafter recovering an aqueous sucrose containing stream by passing a desorbent material into the adsorption zone at desorption conditions to effect the displacement of sucrose from the adsorbent.

In another embodiment the present invention comprises a cyclical process for separating sucrose from thick juice, each cycle of which comprises: (a) contacting the mixture at adsorption conditions with a solid adsorbent exhibiting selectivity for the sucrose comprising a stabilized type Y zeolite, thereby selectively adsorbing the sucrose on the adsorbent; (b) removing a raffinate stream from the adsorption zone; (c) recovering the sucrose from the adsorbent by desorption at desorption conditions with a desorbent comprising alcohol, the adsorbent exhibiting an affinity for the alcohol; and (d) flushing the alcohol from the adsorbent with water.

In another embodiment, the invention is a process for separating sucrose from an aqueous solution of sucrose and thick juice which process comprises contacting at adsorption conditions the mixture with a solid adsorbent exhibiting selectivity for the sucrose comprising a stabilized type Y zeolite, which process comprises the steps of: (a) maintaining net fluid flow through a column of the adsorbent in a single direction, which column contains at least three zones having separate operational functions occurring therein and being serially interconnected with the terminal zones of the column connected to provide a continuous connection of the zones; (b) maintaining an adsorption zone in the column, the zone defined by the adsorbent located between a feed inlet stream at an upstream boundary of the zone and a raffinate outlet stream at a downstream boundary of the zone; (c) maintaining a purification zone immediately upstream from the adsorption zone, the purification zone defined by the adsorbent located between an extract outlet stream at an upstream boundary of the purification zone and the feed inlet stream at a downstream boundary of the purification zone; (d) maintaining a desorption zone immediately upstream from the purification zone, the desorption zone defined by the adsorbent located between a desorbent inlet stream at an upstream boundary of the zone and the extract outlet stream at a downstream boundary of the zone; (e) maintaining a buffer zone immediately upstream from the desorption zone, the buffer zone defined as the adsorbent located between the desorbent input stream at a downstream boundary of the buffer zone and a raffinate output stream at an upstream boundary of the buffer zone; (f) passing the feed stream into the adsorption zone at adsorption conditions to effect the selective adsorption of sucrose by the adsorbent in the adsorption zone and withdrawing a raffinate outlet stream from the adsorption zone; (g) passing a desorbent comprising alcohol into the desorption zone at desorption conditions to effect the displacement of the sucrose from the adsorbent in the desorption zone, the adsorbent exhibiting an affinity for the desorbent; (h) withdrawing an extract stream comprising the sucrose and desorbent material from the desorption zone; (i) passing a water inlet stream into the buffer zone at the upstream boundary of the zone to effect the flushing of the alcohol from the adsorbent in the buffer zone; and (j) periodically advancing through the column of adsorbent in a downstream direction with respect to fluid flow in the adsorption zone the feed inlet stream, raffinate outlet stream, desorbent inlet stream, extract outlet stream and water inlet stream to effect the shifting of zones through the adsorbent and the production of extract outlet and raffinate outlet stream.

Other objects and embodiments of the invention encompass details about feed mixtures, adsorbents, process schemes, desorbent materials and operating conditions, all of which are hereinafter disclosed in the following discussions of each of the facets of the present invention.

BRIEF DESCRIPTION OF THE FIGURE

The FIGURE represents, in schematic form, the embodiment of the present invention incorporating a simulated moving bed, hereinafter described, including adsorption column 1, manifold system 3 and various interconnecting lines.

DETAILED DESCRIPTION OF THE INVENTION

As hereinbefore set forth, the present invention is conconcerned with a process for separating sucrose from thick juice. The process is effected by passing the feed mixture over an adsorbent of the type hereinafter set forth in greater detail. The passage of the feed stream over the adsorbent will result in the adsorption of sucrose while permitting the other components of the feed stream to pass through the treatment zone in an unchanged condition. Thereafter the sucrose will be desorbed from the adsorbent by treating the adsorbent with a desorbent material. Preferred adsorption and desorption conditions include a temperature in the range of from about 20° C. to about 200° C. and a pressure in the range of from about atmospheric to about 500 psig to ensure a liquid phase.

For purposes of this invention the various terms which are hereinafter used may be defined in the following manner.

A feed mixture is a mixture containing one or more extract components and one or more raffinate components to be separated by our process. The term "feed stream" indicates a stream of a feed mixture which passes to the adsorbent used in the process.

An "extract component" is a compound or type of compound that is more selectively adsorbed by the adsorbent while a "raffinate component" is a compound or type of compound that is less selectively adsorbed. The term "desorbent material" shall mean generally a material capable of desorbing an extract component. The term "desorbent stream" or "desorbent input stream" indicates the stream through which desorbent material passes to the adsorbent. The term "raffinate stream" or "raffinate output stream" means a stream through which an raffinate component is removed from the adsorbent. The composition of the raffinate stream can vary from essentially 100% desorbent material to essentially 100% raffinate components. The term "extract stream" or "extract output stream" shall mean a stream through which an extract material which has been desorbed by a desorbent material is removed from the adsorbent. The composition of the extract stream, likewise, can vary from essentially 100% desorbent material to essentially 100% extract components. At least a portion of the extract stream and preferably at least a portion of the raffinate stream from the separation process are passed to separation means, typically fractionators, where at least a portion of desorbent material is separated to produce an extract product and a raffinate product. The terms "extract product" and "raffinate product" means products produced by the process containing, respectively, an extract component and a raffinate component in higher concentrations than those found in the extract stream and the raffinate stream.

The adsorbent which is employed by this invention to selectively adsorb sucrose from thick juice comprises a modified type Y crystalline aluminosilicate or zeolite. This material is referred to as a "stabilized Y zeolite" and may be obtained from the Union Carbide Corporation which designates such material as "LZ-Y20". Aluminosilicates or zeolites, in general, are described as a three-dimensional network of fundamental structural units consisting of silicon-centered $SiO_4$ and aluminum-centered $AlO_4$ tetrahedra interconnected by a mutual sharing of apical oxygen atoms. The space between the tetrahedra is occupied by water molecules and subsequent dehydration of partial dehydration results in a crystal structure interlaced with channels of molecular dimension.

Thus, the crystalline aluminosilicates are often referred to as molecular sieves and separations performed with molecular sieves are generally thought to take place by a physical "sieving" of smaller from larger molecules appearing in the feed mixture. In the separation of aromatic hydrocarbon isomers, however, the separation of the isomers apparently occurs because of differences in electrochemical attraction of the different isomers and the adsorbent rather than on pure physical size differences in the isomer molecules.

In hydrated form, the crystalline aluminosilicates generally encompass those zeolites represented by Formula 1 below:

$$M_{2/n}O:Al_2O_3:wSiO_2:yH_2O \qquad \text{Formula 1}$$

where "M" is a cation which balances the electrovalence of the tetrahedra and is generally referred to as an exchangeable cationic site, "n" represents the valence of the cation, "w" represents the moles of $SiO_2$, and "y" represents the moles of water. The cations may be any one of a number of cations which will hereinafter be described in detail.

Adsorbents comprising the type X structured and type Y structured zeolites are described and defined in U.S. Pat. Nos. 2,882,244 and 3,130,007 respectively. The term "type X structured" and "type Y structured" zeolites as used herein shall include all zeolites which have general structures as represented in the above two cited patents.

The type X structured zeolite in the hydrated or partially hydrated form can be represented in terms of mole oxides as shown in Formula 2 below:

$$(0.9\pm0.2)M_{2/n}O:Al_2O_3:(2.5\pm0.5)SiO_2:yH_2O \qquad \text{Formula 2}$$

where "M" represents at least one cation having a valence of not more than 3, "n" represents the valence of "M", and "y" is a value up to about 9 depending upon the identity of "M" and the degree of hydration of the crystal. The cation "M" may be one or more of a number of cations such as the hydrogen cation, the alkali metal cation, or the alkaline earth cations or other selected cations, and is generally referred to as an exchangeable cationic site.

The type Y structured zeolite in the hydrated or partially hydrated form can be similarly represented in terms of mole oxides as in Formula 3 below:

$$(0.9\pm0.2)M_{2/n}O:Al_2O_3:wSiO_2:yH_2O \qquad \text{Formula 3}$$

where "M" is at least one cation having a valence not more than 3, "n" represents the valence of "M", "w" is a value greater than about 3 up to 8, and "y" is a value up to about 9 depending upon the identity of "M" and the degree of hydration of the crystal.

The terms "type X zeolite" and type Y zeolite" as employed herein shall refer not only to type X structured and type Y structured zeolites containing sodium cations as the cation "M" indicated in the formulas above but also shall refer to those containing other additional cations such as cations included in Groups IA and IIA of the Periodic Table of the Elements, i.e. the alkali metals and alkaline earth metals, respectively. Typically both the type X and type Y structured zeolites as initially prepared are predominantly in the sodium form. The term "exchanged cationic site" generally refers to the site in the zeolite occupied by the cation "M". This cation, usually sodium, can be replaced or exchanged with other specific cations, such as those mentioned above, depending on the type of the zeolite to modify characteristics of the zeolite.

The stabilized Y zeolite as required by the present invention can be more particularly defined as an organophilic zeolitic aluminosilicate having a chemical $SiO_2/Al_2O_3$ molar ratio of from 4.5 to 6, the essential X-ray powder diffraction pattern of zeolite Y, a BET surface area of at least 350 $m^2/g$ and an adsorptive capacity for water vapor at 25° C.and a water vapor pressure of 2.4 Torr of from 6 to 12 wt. -%. This may be compared to water adsorptive capacity for zeolite Y under similar conditions of from 20 to 25 wt.%.

Surface areas of LZ-Y20 are determined by the well-known Brunauer-Emmett-Teller method (B-E-T) (S. Brunauer, P. Emmett and E. Teller, J. Am. Chem. Soc. 60, 309 [1938]) using nitrogen as the adsorbate.

The essential X-ray powder diffraction pattern of zeolite Y is set forth in U.S. Pat. No. 3,130,007, to Breck. It will be understood that the shrinkage of the unit cell resulting from the stabilization process for converting zeolite Y to LZ-Y20 will cause some slight shift in the d-spacings. In all events, the X-ray diffraction pattern of the LZ-Y20 compositions will exhibit at least the d-spacings corresponding to the Miller Indices of Table A below, and can contain all the other d-spacings permissible to the face centered cubic system with a unit cell edge of 24.20 to 24.45 Angstroms. This may be compared to a unit cell edge of 24.7 Angstroms for Y-zeolite. The value of the d-spacings in Angstroms can be readily calculated by substitution in the formula:

$$d_{hkl} = \frac{a_o}{(h^2 + k^2 + l^2)^{\frac{1}{2}}}$$

where h, k and l are the Miller indices. The X-ray pattern of the LZ-Y20 is obtained by standard X-ray powder techniques. The radiation source is a high intensity, copper target, X-ray tube operated at 50 Kv and 40 ma. The diffraction pattern from the copper K radiation and graphite monochromator is suitably recorded by an X-ray spectrometer scintillation counter, pulse height analyzer and strip chart recorder. Flat compressed powder samples are scanned at 1° per minute, using a 2 second time constant. Interplanar spacings (d) are obtained from Bragg Angle (2 theta) positions of peaks after subtracting background. The crystal symmetry is cubic.

TABLE A

| Miller Indices (hkl) | Intensity |
|---|---|
| 111 | very strong |
| 220 | medium |
| 311 | medium |
| 331 | strong |
| 333; 511 | medium |
| 440 | medium |
| 533 | strong |
| 642 | strong |
| 751; 555 | strong |

The anhydrous state of any zeolite composition for purposes of determining constituent proportions in terms of weight percent is the condition of the zeolite after being fired in air at 1000° C. for one hour.

For the determination of the sorptive capacity of LZ-Y20 for any particular adsorbate, for example water, the test zeolite sample is activated by preheating at 425° C. for 16 hours at a pressure of 5 micrometers of mercury in a conventional McBain apparatus. Thereafter, the temperature of the sample is adjusted to the desired value and contacted with the vapor of the test adsorbate the desired pressure.

Typically, adsorbents used in separative processes contain zeolite crystals and amorphous material. The adsorbents which are employed by this invention comprise the stabilized Y zeolite which is preferably bound with a binder material comprising a water permeable organic polymer. To be water permeable, the organic polymer, when a dry solid, will have throughout its mass small void spaces and channels which will allow an aqueous solution to penetrate the polymer and thereby come into contact with the zeolite particles bound by the polymer. We have found cellulose acetate to be particularly suitable for use in the adsorbent of this invention. The preferred concentration of the organic polymer in the adsorbent is from about 3.0 to about 50.0 wt.%.

The adsorbent of this invention may be manufactured by mixing together powder of the stabilized Y-zeolite, powder of the water permeable organic polymer binder, and a liquid organic solvent to make the mixture malleable, forming the mixture into discrete formations, removing the solvent from the formations and breaking the formations into the desired sized particles. The forming of the malleable mixture is preferably done by extrusion. The zeolite and binder powders may first be mixed together and the solvent added to the powder mixture, or the binder powder may be first dissolved in the solvent and the zeolite added to the solution. Preferred liquid organic solvents are p-dioxane, methylethyl ketone, acetone, chloroform, benzyl alcohol, acetic acid, ethyl acetate and cyclohexanone, any of which may be mixed with formamide. The solvent is removed from the formations either by water washing followed by drying at about room temperature (20° C.), or by just drying at that temperature. The formations are broken into particles having a preferred size such that the particles will pass through a No. 30 screen and be retained on a No. 60 screen. Any fines resulting from the breaking of the particles not retained on a No. 60 screen may be added to the activated carbon-solvent binder mixture. It is important to note that the zeolitic adsorbent used for the removal of sucrose, in accordance with this invention, serves the additional function of filtering out the solid material usually found in thick juice. The adsorbent is preferably packed in a vertical column through which the feed mixture is passed, preferably downwardly.

The adsorbent of this invention used for the adsorption of sucrose is said to possess adsorptive selectivity for sucrose as compared to other components of the thick juice. In general, relative selectivity can be expressed not only for one feed compound as compared to another but can also be expressed between any feed mixture component and the desorbent material. The selectivity, (B), as used throughout this specification is defined as the ratio of the two components of the adsorbed phase over the ratio of the same two components in the unadsorbed phase at equilibrium conditions. Relative selectivity is shown as Equation 1, below.

$$\text{Selectivity} = (B) = \frac{[\text{wt. percent } C/\text{wt. percent } D]_A}{[\text{wt. percent } C/\text{wt. percent } D]_U} \qquad \text{Equation 1}$$

where C and D are two components of the feed represented in weight percent and the subscripts A and U represent the adsorbed and unadsorbed phases, respectively. The equilibrium conditions are determined when the feed passing over a bed of adsorbent does not change composition after contacting the bed of adsorbent. In other words, there is no net transfer of material occurring between the unadsorbed and adsorbed phases. Where selectivity of two components approaches 1.0, there is no preferential adsorption of one component by the adsorbent with respect to the other; they are both adsorbed (or nonadsorbed) to about the same degree with respect to each other. As the (B) becomes less than or greater than 1.0, there is preferential adsorption by the adsorbent for one component with respect to the other. When comparing the selectivity by the adsorbent of one component C over component D, a (B) larger than 1.0 indicates preferential adsorption of component C within the adsorbent. A (B) less than 1.0 would indicate that component D is preferentially adsorbed leaving an unadsorbed phase richer in component C and an adsorbed phase richer in component D. Ideally desorbent materials should have a selectivity equal to about 1 or slightly less than 1 with respect to all extract components so that all of the extract components can be desorbed as a class with reasonable flow rates of desorbent material, and so that extract components can displace desorbent material in a subsequent adsorption step. While separation of an extract component from a raffinate component is theoretically possible when the selectivity of the adsorbent for the extract component with respect to the raffinate component is greater than 1, it is preferred that such selectivity approach a value of 2. Like relative volatility, the higher the selectivity, the easier the separation is to perform. Higher selectivities permit a smaller amount of adsorbent to be used. The third important characteristic is the rate of exchange of the extract component of the feed mixture material or, in other words, the relative rate of desorption of the exact component. This characteristic relates directly to the amount of desorbent material that must be employed in the process to recover the extract component from the adsorbent; faster rates of exchange reduce the amount of desorbent material needed to remove the extract component and therefore permit a reduction in the operating cost of the process. With faster rates of exchange, less desorbent material has to be pumped through the process and separated from the extract stream for reuse in the process.

The feed mixtures which are charged to the process of the present invention will comprise thick juice particularly sugar beet thick juice which contains solutes comprising about 80 wt.% dissolved solids including 50 wt.% sucrose as well as other sugars such as glucose, fructose, raffinose, as well as inorganic salts and alkaloids, betaine, said other sugars and compounds being present in varying amounts. Betaine is a colorless, inert, crystalline, alkaloidal substance having the formula $C_5H_{11}NO_2H_2O$. It is highly desirable for the thick juice to be diluted with water to the extent that the feed mixture comprises from about 30 wt.% to about 60 wt.% dissolved solids, since the 80 wt.% dissolved solids thick juice is very viscous and difficult to pump through the bed of adsorbent.

Desorbent materials used in various prior art adsorptive separation processes vary depending upon such factors as the type of operation employed. In the swing-bed system, in which the selectively adsorbed feed component is removed from the adsorbent by a purge stream, desorbent selection is not as critical and desorbent material comprising gaseous hydrocarbons such as methane, ethane, etc., or other types of gases such as nitrogen or hydrogen, may be used at elevated temperatures or reduced pressures or both to effectively purge the adsorbed feed component from the adsorbent. However, in adsorptive separation processes which are generally operated continuously at substantially constant pressures and temperatures to insure liquid phase, the desorbent material must be judiciously selected to satisfy many criteria. First, the desorbent material should displace an extract component from the adsorbent with reasonable mass flow rates without itself being so strongly adsorbed as to unduly prevent an extract component from displacing the desorbent material in a following adsorption cycle. Expressed in terms of the selectively (hereinafter discussed in more detail), it is preferred that the adsorbent be more selective for all of the extract components with respect to a raffinate component than it is for the desorbent material with respect to a raffinate component. Secondly, desorbent materials must be compatible with the particular adsorbent and the particular feed mixture. More specifically, they must not reduce or destroy the critical selectivity of the adsorbent for an extract component with respect to a raffinate component. Additionally, desorbent materials should not chemically react with or cause a chemical reaction of either an extract component or a raffinate component. Both the extract stream and the raffinate stream are typically removed from the adsorbent in admixture with desorbent material and any chemical reaction involving a desorbent material and an extract component or a raffinate product or both would be detrimental to the process. Since both the raffinate stream and the extract stream typically contain desorbent materials, desorbent materials should additionally be substances which are easily separable from the feed mixture that is passed into the process. Without a method of separating at least a portion of the desorbent material present in the extract stream and the raffinate stream, the concentration of an extract component in the extract product and the concentration of a raffinate component in the raffinate product would not be very high, nor would the desorbent material be available for reuse in the process. It is contemplated that at least a portion of the desorbent material will be separated from the extract and the raffinate streams by distillation or evaporation, but other separation methods such as reverse osmosis may also be employed alone or in combination with distillation or evaporation. Since the raffinate and extract products are foodstuffs intended for human consumption, desorbent materials should also be non-toxic. Finally, desorbent materials should also be materials which are readily available and therefore reasonable in cost.

The desorbent material found to be most effective in desorbing the sucrose comprises alcohol, particularly alcohol in aqueous solution in which the alcohol comprises from about 10 vol.% to about 40 vol.% of the solution. The most preferred alcohols contain not greater than four carbon atoms per molecule, but ethanol is particularly preferred because it is safe to use with food products, i.e. the products obtained from the process of the present invention are likely to be used for human or animal consumption. The problem when alcohol is so used is that the adsorbent has a high affinity for alcohol and as a result the sucrose is unable to effectively displace the alcohol, particularly ethanol, from the adsorbent when the adsorbent is reused in the adsorption step. This inability results in a substantial loss of sucrose into the raffinate. In spite of this high affinity of the adsorbent for the alcohol, the surprising observation has been made that water is very effective in displacing the alcohol from the adsorbent and if a water flush step is included between the desorption and adsorption steps, adsorption of the sucrose will efficiently occur in an alcohol-free environment.

A dynamic testing apparatus is employed to test various adsorbents with a particular feed mixture and desorbent material to measure the adsorbent characteristics of adsorptive capacity, selectivity and exchange rate. The apparatus consists of an adsorbent chamber of approximately 70 cc volume having inlet and outlet portions at opposite ends of the chamber. The chamber is contained within a temperature control means and, in addition, pressure control equipment is used to operate the chamber at a constant predetermined pressure. Quantitative and qualitative analytical equipment such as refractometers, polarimeters and chromatographs can be attached to the outlet line of the chamber and used to detect quantitatively or determine qualitatively one or more components in the effluent stream leaving the adsorbent chamber. A pulse test, performed using this apparatus and the following general procedure, is used to determine selectivities and other data for various adsorbent systems. The adsorbent is filled to equilibrium with a particular desorbent material by passing the desorbent material through the adsorbent chamber. At a convenient time, a pulse of feed comprising thick juice diluted in desorbent is injected for a duration of several minutes. Desorbent flow is resumed, and the sucrose and the other components of the thick juice are eluted as in a liquid-solid chromatographic operation. The effluent can be analyzed on-stream or alternatively effluent samples can be collected periodically and later analyzed separately by analytical equipment and traces of the envelopes of corresponding component peaks developed.

From information derived from the test adsorbent performance can be rated in terms of void volume, retention volume for an extract or a raffinate component, selectively for one component with respect to the other, and the rate of desorption of an extract component by the desorbent. The retention volume of an extract or a raffinate component may be characterized by the distance between the center of the peak envelope of an extract or a raffinate component and the peak envelope of the tracer component or some other known reference point. It is expressed in terms of the volume in cubic centimeters or desorbent pumped during this time interval represented by the distance between the peak envelopes. Selectivity, (B), for an extract component with respect to a raffinate component may be characterized by the ratio of the distance between the center of the extract component peak envelope and the tracer peak envelope (or other reference point) to the corresponding distance between the center of the raffinate component peak envelope and the tracer peak envelope. The rate of exchange of an extract component with the desorbent can generally be characterized by the width of the peak envelopes at half intensity. The narrower the peak width the faster the desorption rate. The desorption rate can also be characterized by the distance between the center of the tracer peak envelope and the disappearance of an extract component which has just been desorbed. This distance is again the volume of desorbent pumped during this time interval.

The adsorbent may be employed in the form of a dense compact fixed bed which is alternatively contacted with the feed mixture, desorbent materials and water flush. In the simplest embodiment of the invention the adsorbent is employed in the form of a single static bed in which case the process is only semi-continuous. In another embodiment a set of two or more static beds may be employed in fixed-bed contacting with appropriate valving so that the feed mixture is passed through one or more adsorbent beds while the desorbent materials and water flush can be passed through one or more of the other beds in the set. The flow of feed mixture, desorbent materials and water flush may be either up or down through the desorbent. Any of the conventional apparatus employed in static bed fluid-solid contacting may be used.

Countercurrent moving bed or simulated moving bed countercurrent flow systems, however, have a much greater separation efficiency than fixed adsorbent bed systems and are therefore preferred. In the moving bed or simulated moving bed process the adsorption, desorption and flushing operations are continuously taking place which allows both continuous production of an extract and a raffinate stream and the continual use of feed, desorbent and flush streams. One preferred embodiment of this process utilizes what is known in the art as the simulated moving bed countercurrent flow system. The operating principles and sequence of such a flow system are described in U.S. Pat. No. 2,985,589, incorporated herein by reference. In such a system it is the progressive movement of multiple liquid access points down an adsorbent chamber that simulates the upward movement of adsorbent contained in the chamber. Only five of the access lines are active at any one time; the feed input stream, desorbent inlet stream, water flush inlet stream, raffinate outlet stream, and extract outlet stream access lines. Coincident with this simulated upward movement of the solid adsorbent is the movement of the liquid occupying the void volume of the packed bed of adsorbent. So that the countercurrent contact is maintained, a liquid flow down the adsorbent chamber may be provided by a pump. As an active liquid access point moves through a cycle, that is, from the top of the chamber to the bottom, the chamber circulation pump moves through different zones which require different flow rates. A programmed flow controller may be provided to set and regulate these flow rates.

The active liquid access points effectively divide the adsorbent chamber into separate zones, each of which has a different function. In this embodiment of the process, it is generally necessary that three separate operational zones be present in order for the process to take place although in some instances an optional fourth zone may be used.

There is a net positive fluid flow through all portions of the column in the same direction, although the composition and rate of the fluid will, of course, vary from point to point. With reference to the Figure, zones I, II, III and IV are shown as well as manifold system 3, pump 2, which maintains the net positive fluid flow, and line 4 associated with pump 2. Also shown and identified are the inlet and outlet lines to the process which enter or leave via manifold system 3.

The adsorption zone, zone I, is defined as the adsorbent located between the feed inlet stream 5 and the raffinate outlet stream 4. In this zone, the feedstock contacts the adsorbent, an extract component is adsorbed, and a raffinate stream is withdrawn. Since the general flow through zone I is from the feed stream which passes into the zone to the raffinate stream which passes out of the zone, the flow in this zone is considered to be a downstream direction when proceeding from the feed inlet to the raffinate outlet streams. The water flush stream 12 may be introduced in zone I at a point slightly downstream of the feed inlet stream. The water will be added at a rate sufficient to displace the alcohol associated with the packed bed of adsorbent in simulated movement in zone I, thereby facilitating the adsorption of the sucrose.

Immediately upstream with respect to fluid flow in zone I is the purification zone, zone II. The purification zone is defined as the adsorbent between the extract outlet stream 11 and the feed inlet stream 5. The basic operations taking place in zone II are the displacement from the non-selective void volume of the adsorbent of any raffinate material carried into zone II by the shifting of adsorbent into this zone and the desorption of any raffinate material adsorbed within the selective pore volume of the adsorbent or adsorbed on the surfaces of the adsorbent particles. Purification is achieved by passing a portion of extract stream material leaving zone III into zone II at zone II's upstream boundary, the extract outlet stream, to effect the displacement of raffinate material. The flow of material in zone II is in a downstream direction from the extract outlet stream to the feed inlet stream.

Immediately upstream of zone II with respect to the fluid flowing in zone II is the desorption zone or zone III. The desorption zone is defined as the adsorbent between the desorbent inlet 13 and the extract outlet stream 11. The function of the desorption zone is to allow a desorbent material which passes into this zone to displace the extract component which was adsorbed upon the adsorbent during a previous contact with feed in zone I in a prior cycle of operation. The flow of fluid in zone III is essentially in the same direction as that of zones I and II.

In some instances an optional buffer zone, zone IV, may be utilized. This zone, defined as the adsorbent between the raffinate outlet stream 4 and the desorbent inlet stream 13, if used, is located immediately upstream with respect to the fluid flow to zone III. Zone IV would be utilized to conserve the amount of desorbent utilized in the desorption step since a portion of the raffinate stream which is removed from zone I can be passed into zone IV to displace desorbent material present in that zone out of that zone into the desorption zone. Zone IV will contain enough adsorbent so that raffinate material present in the raffinate stream passing out of zone I and into zone IV can be prevented from passing into zone III thereby contaminating extract stream removed from zone III. In the instances in which the fourth operational zone is not utilized the raffinate stream passed from zone I to zone IV must be carefully monitored in order that the flow directly from zone I to zone III can be stopped when there is an appreciable quantity of raffinate material present in the raffinate stream passing from zone I into zone III so that the extract outlet stream is not contaminated.

In the most preferred embodiment of the present invention zone IV will be employed and the water flush stream will be introduced not into zone I, but into zone IV at the upstream boundary of zone IV as shown by the dotted line 12' in the Figure. In this way the alcohol that would otherwise move into zone IV from zone III as part of the simulated moving adsorbent bed will be kept in zone III, assuming that the correct amount of water flush is used. This will also reduce the alcohol-water desorbent requirements. Thus, when the adsorbent enters zone I, it will have the proper all water environment.

A cyclic advancement of the input and output streams through the fixed bed of adsorbent can be accomplished by utilizing a manifold system in which the valves in the manifold are operated in a sequential manner to effect the shifting of the input and output streams thereby allowing a flow of fluid with respect to solid adsorbent in a countercurrent manner. Another mode of operation which can effect the countercurrent flow of solid adsorbent with respect to fluid involves the use of a rotating disc valve in which the input and output streams are connected to the valve and the lines through which feed input, water flush input, extract output, desorbent input and raffinate output streams are advanced in the same direction through the adsorbent bed. Both the manifold arrangement and disc valve are known in the art. Specifically rotary disc valves which can be utilized in this operation can be found in U.S. Pat. Nos. 3,040,777 and 3,422,848. Both of the aforementioned patents disclose a rotary type connection valve in which the suitable advancement of the various input and output streams from fixed sources can be achieved without difficulty.

In many instances, one operational zone will contain a much larger quantity of adsorbent than some other operational zone. For instance, in some operations the buffer zone can contain a minor amount of adsorbent as compared to the adsorbent required for the adsorption and purification zones. It can also be seen that in instances in which desorbent is used which can easily desorb extract material from the adsorbent that a relatively small amount of adsorbent will be needed in a desorption zone as compared to the adsorbent needed in the buffer zone or adsorption zone or purification zone or all of them. Since it is not required that the adsorbent be located in a single column, the use of multiple chambers or a series of columns is within the scope of the invention.

It is not necessary that all of the input or output streams be simultaneously used, and in fact, in many instances some of the streams can be shut off while others effect an input or output of material. The apparatus which can be utilized to effect the process of this invention can also contain a series of individual beds connected by connecting conduits upon which are placed input or output taps to which the various input or output streams can be attached and alternately and periodically shifted to effect continuous operation. In some instances, the connecting conduits can be connected to transfer taps which during the normal operations do not function as a conduit through which material passes into or out of the process.

It is contemplated that at least a portion of the extract output stream will pass into a separation means wherein at least a portion of the desorbent material can be separated to produce an extract product containing a reduced concentration of desorbent material. Preferably, but not necessary to the operation of the process, at least a portion of the raffinate output stream will also be passed to a separation means wherein at least a portion of the desorbent material can be separated to produce a desorbent stream which can be reused in the process and a raffinate product containing a reduced concentration of desorbent material. The separation means will typically be a fractionation column, the design and operation of which is well-known to the separation art.

Although both liquid and vapor phase operations can be used in many adsorptive separation processes, liquid-phase operation is preferred for this process because of the lower temperature requirements and because of the higher yields of extract product that can be obtained with liquid-phase operation over those obtained with vapor-phase operation. Adsorption conditions will include a temperature range of from about 20° C. to about 200° C., with about 20° C. to about 100° C. being more preferred and a pressure range of from about 250 psig being more preferred to insure liquid phase. Desorption conditions will include the same range of temperatures and pressures as used for adsorption conditions.

The size of the units which can utilize the process of this invention can vary anywhere from those of pilot plant scale (see for example our assignee's U.S. Pat. No. 3,706,812) to those of commercial scale and can range in flow rates from as little as a few cc an hour up to many thousands of gallons per hour.

The following example is given to illustrate the process of this invention, however, it is to be understood that this example is given merely for purposes of illustration, and that the present invention is not necessarily limited thereto.

EXAMPLE

The purpose of this example is to present the results of a pulse test obtained from the above described pulse test apparatus when using the aforementioned Union Carbide Corporation adsorbent bound with 20 wt.% cellulose acetate. The feed pulse was 10 ml and comprised a 50:50 mixture of thick juice and water containing 38 wt.% dissolved solids, including sucrose (31 wt.%), raffinose (0.1 wt.%), betaine (0.1 wt.%) and potassium chloride (0.3 wt.%). An additional 0.4 g of KCl and 0.4 g of raffinose was added to provide a better resolution of the ability of the adsorbent to separate sucrose from the other components. The column was operated at 60° C. The desorbent used was a 20:80 ethanol:water mixture. Before the feed pulse, 50 ml of water was passed through the column as a prepulse. The flow rate was 1 LHSV.

Following are the results obtained:

| | |
|---|---|
| Half Widths | |
| KCl | 11.9 |
| Sucrose | 14.2 |
| Raffinose | 10.4 |
| Betaine | 9.7 |
| Unknown | 13.6 |
| Color substances | 15.3 |
| Retention Volumes | |
| KCl | 8.4 |
| Sucrose | 18.0 |
| Raffinose | 11.8 |
| Betaine | 11.0 |
| Unknown | 14.1 |
| Color substances | 6.7 |
| B | |
| Sucrose/KCl | 2.1 |
| Sucrose/Raffinose | 1.5 |
| Sucrose/Betaine | 1.6 |
| Sucrose/Unknown | 1.3 |
| Sucrose/Color | 2.7. |

The above data illustrates that the LZ-20 adsorbent, in contradistinction to other zeolitic material, such as Y-zeolite, is selective for sucrose while rejecting KCl, raffinose, betaine, colored substances and the unknown compound.

We claim as our invention:

1. A process for separating sucrose from a feed mixture comprising thick juice which comprises contacting said mixture at adsorption conditions in an adsorption zone with an adsorbent exhibiting selectivity for said sucrose comprising a stabilized type Y zeolite, thereby selectively adsorbing said sucrose thereon, removing a raffinate stream from said adsorption zone, and thereafter recovering an aqueous sucrose-containing stream by passing a desorbent material into said adsorption zone at desorption conditions to effect the displacement of sucrose from said adsorbent.

2. The process of claim 1 wherein said adsorption and desorption conditions include a temperature in the range of from about 20° C. to about 200° C. and a pressure sufficient to maintain liquid phase.

3. The process of claim 1 wherein said desorption conditions include a temperature in the range of from about 20° C. to about 200° C. and a pressure sufficient to maintain liquid phase.

4. The process of claim 1 wherein said desorbent comprises an alcohol-water mixture containing from about 10 vol.% to about 40 vol.% of alcohol having not greater than four carbon atoms per molecule.

5. The process of claim 4 wherein said alcohol comprises ethanol.

6. The process of claim 1 wherein said adsorbent is bound with a water permeable organic polymer binder.

7. The process of claim 6 wherein said organic polymer comprises cellulose acetate.

8. A cyclical process for separating sucrose from thick juice, each cycle of which comprises:

(a) contacting said mixture at adsorption conditions with a solid adsorbent exhibiting selectivity for said sucrose comprising a stabilized type Y zeolite, thereby selectively adsorbing said sucrose on said adsorbent;

(b) removing a raffinate stream from said adsorption zone;

(c) recovering said sucrose from said adsorbent by desorption at desorption conditions with a desorption comprising alcohol; and (d) flushing said alcohol from said adsorbent with water.

9. The process of claim 8 wherein said desorbent comprises an alcohol-water mixture containing from about 10 vol.% to about 40 vol.% of alcohol having not greater than four carbon atoms per molecule.

10. The process of claim 9 wherein said alcohol comprises ethanol.

11. The process of claim 8 wherein said adsorbent is bound with a water permeable organic polymer binder.

12. The process of claim 11 wherein said organic polymer comprises cellulose acetate.

13. A process for separating sucrose from thick juice, which process comprises contacting at adsorption conditions the mixture with a solid adsorbent exhibiting selectivity for said sucrose comprising a stabilized type Y zeolite, which process comprises the steps of:

(a) maintaining net fluid flow through a column of said adsorbent in a single direction, which column contains at least three zones having separate operational functions occurring therein and being serially interconnected with the terminal zones of said column connected to provide a continuous connection of said zones;

(b) maintaining an adsorption zone in said column, said zone defined by the adsorbent located between a feed inlet stream at an upstream boundary of said zone and a raffinate outlet stream at a downstream boundary of said zone;

(c) maintaining a purification zone immediately upstream from said adsorption zone, said purification zone defined by the adsorbent located between an extract outlet stream at an upstream boundary of said purification zone and said feed inlet stream at a downstream boundary of said purification zone;

(d) maintaining a desorption zone immediately upstream from said purification zone, said desorption zone defined by the adsorbent located between a desorbent inlet stream at an upstream boundary of said zone and said extract outlet stream at a downstream boundary of said zone;

(e) maintaining a buffer zone immediately upstream from said desorption zone, said buffer zone defined as the adsorbent located between the desorbent input stream at a downstream boundary of said buffer zone and a raffinate output stream at an upstream boundary of said buffer zone;

(f) passing said feed stream into said adsorption zone at adsorption conditions to effect the selective adsorption of sucrose by said adsorbent in said adsorption zone and withdrawing raffinate outlet stream from said adsorption zone;

(g) passing a desorbent comprising alcohol into said desorption zone at desorption conditions to effect the displacement of said sucrose from the adsorbent in said desorption zone;

(h) withdrawing an extract stream comprising said sucrose and desorbent material from said desorption zone;

(i) passing a water inlet stream into said buffer zone at the upstream boundary of said zone to effect the flushing of said alcohol from said adsorbent in said buffer zone; and (j) periodically advancing through said column of absorbent in a downstream direction with respect to fluid flow in said adsorption zone the feed inlet stream, raffinate outlet stream, desorbent inlet stream, extract outlet stream and water inlet stream to effect the shifting of zones through said adsorbent and the production of extract outlet and raffinate outlet streams.

14. The process of claim 13 wherein said desorbent comprises an alcohol-water mixture containing from about 10 vol.% to about 40 vol.% of alcohol having not greater than four carbon atoms per molecule.

15. The process of claim 14 wherein said alcohol comprises ethanol.

16. The process of claim 13 in which said adsorption and desorption conditions include a temperature in the range of from about 20° C. to about 200° C. and a pressure in the range of from about atmospheric to about 500 psig to ensure liquid phase.

17. The process of claim 13 wherein said adsorbent is bound with a water permeable organic polymer binder.

18. The process of claim 17 wherein said organic polymer comprises cellulose acetate.

* * * * *